US010524500B2

(12) United States Patent
Sebastian et al.

(10) Patent No.: US 10,524,500 B2
(45) Date of Patent: Jan. 7, 2020

(54) STAPLE FIBER BLEND FOR USE IN THE MANUFACTURE OF CIGARETTE FILTER ELEMENTS

(71) Applicant: R.J. Reynolds Tobacco Company, Winston-Salem, NC (US)

(72) Inventors: Andries Don Sebastian, Clemmons, NC (US); Evon L. Crooks, Mocksville, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 131 days.

(21) Appl. No.: 15/179,413

(22) Filed: Jun. 10, 2016

(65) Prior Publication Data

US 2017/0354179 A1 Dec. 14, 2017

(51) Int. Cl.

| | |
|---|---|
| ***A24D 3/06*** | (2006.01) |
| ***A24D 3/10*** | (2006.01) |
| ***A24D 3/14*** | (2006.01) |
| ***A24D 3/02*** | (2006.01) |
| ***A24D 3/04*** | (2006.01) |

(52) U.S. Cl.

CPC ..... *A24D 3/068* (2013.01); *A24D 3/0212* (2013.01); *A24D 3/04* (2013.01); *A24D 3/10* (2013.01); *A24D 3/14* (2013.01)

(58) Field of Classification Search

None

See application file for complete search history.

(56) References Cited

U.S. PATENT DOCUMENTS

| | | | |
|---|---|---|---|
| 2,175,107 | A | 10/1939 | Casablancas |
| 2,728,112 | A | 12/1955 | Berker |
| 2,936,495 | A | 5/1960 | Taine et al. |
| 3,119,396 | A | 1/1964 | Tanquary |
| 3,224,453 | A | 12/1965 | Mahoney et al. |
| 3,249,967 | A | 5/1966 | Varga |

(Continued)

FOREIGN PATENT DOCUMENTS

| | | |
|---|---|---|
| EP | 2 323 506 | 5/2011 |
| WO | WO 95/24520 | 9/1995 |

(Continued)

OTHER PUBLICATIONS

Olea; Kelheim Fibres; http://www.kelheim-fibres.com/pdf/TDS_Olea_0814.pdf; Aug. 2014 (Year: 2014).*

(Continued)

*Primary Examiner* — Eric Yaary

(74) *Attorney, Agent, or Firm* — Womble Bond Dickinson (US) LLP

(57) ABSTRACT

Smoking articles including filter elements formed from two or more fibrous inputs with different physical properties are provided. A first plurality of cellulose acetate staple fibers and a second plurality of degradable polymeric staple fibers are blended to give a fiber mixture, wherein the staple fibers of the fiber mixture are randomly oriented. The degradable polymeric staple fibers can be treated to increase hydrophobicity. The staple fibers of the fiber mixture can then be bonded to form a fibrous bundle which can be incorporated into a filter element. Related methods and mixed fiber products are also provided by the disclosure.

24 Claims, 3 Drawing Sheets

(56) References Cited

U.S. PATENT DOCUMENTS 3,319,629 A 5/1967 Chamberlain
3,353,239 A 11/1967 Heijnis
3,409,946 A 11/1968 Whitehurst
3,413,982 A 12/1968 Sublett et al.
3,424,172 A 1/1969 Neurath
3,429,010 A 2/1969 Fasaroli
3,461,882 A 8/1969 Epstein et al.
3,470,586 A 10/1969 Roberts
3,485,120 A 12/1969 Keith
3,501,361 A * 3/1970 Mumpower ..... A24D 3/0237 156/167
3,552,400 A 1/1971 Berger et al.
3,571,870 A 3/1971 Dixon et al.
3,636,591 A 1/1972 Herubel
3,658,626 A 4/1972 Berger et al.
3,813,740 A 6/1974 Heijnis
3,904,577 A 9/1975 Buisson
3,915,042 A 10/1975 Laird
3,944,485 A 3/1976 Rembaum et al.
4,004,330 A 1/1977 Stanley
4,006,277 A 2/1977 Laird
4,085,760 A 4/1978 Toyoshima et al.
4,095,318 A 6/1978 Abbott et al.
4,141,115 A 2/1979 Fourne et al.
4,173,504 A 11/1979 Tomioka et al.
4,192,041 A 3/1980 Sasaki et al.
4,195,649 A 4/1980 Noguchi et al.
4,237,274 A 12/1980 Leoni et al.
4,252,766 A 2/1981 Baldini et al.
4,268,666 A 5/1981 Baldini et al.
4,281,671 A 8/1981 Bynre et al.
4,388,256 A 6/1983 Ishida et al.
4,489,461 A 12/1984 Hasegawa et al.
4,535,028 A 8/1985 Yokogi et al.
4,538,490 A 9/1985 Becker
4,539,729 A 9/1985 Meile et al.
4,551,887 A 11/1985 Uematsu
4,570,312 A 2/1986 Whitener, Jr.
4,581,886 A 4/1986 Coll-Tortosa
4,669,151 A 6/1987 Krusche
4,763,674 A 8/1988 Lelah
4,768,262 A 9/1988 Gunter
4,811,745 A 3/1989 Cohen et al.
4,831,691 A 5/1989 Hollingsworth et al.
4,876,078 A 10/1989 Arakawa et al.
4,925,602 A 5/1990 Hill et al.
4,947,874 A 8/1990 Brooks et al.
5,025,538 A 6/1991 Saleh
5,225,277 A 7/1993 Takegawa et al.
5,230,960 A 7/1993 Iizuka
5,268,158 A 12/1993 Paul, Jr.
5,271,419 A 12/1993 Arzonico et al.
5,275,859 A 1/1994 Phillips et al.
5,338,605 A 8/1994 Noland et al.
5,387,285 A 2/1995 Rivers
5,441,689 A 8/1995 Laity
5,446,005 A 8/1995 Endo
5,453,144 A 9/1995 Kauffman et al.
5,482,773 A 1/1996 Bair
5,509,430 A 4/1996 Berger
5,536,486 A 7/1996 Nagata et al.
5,622,190 A 4/1997 Arterbery et al.
5,709,227 A 1/1998 Arzonico et al.
5,720,803 A 2/1998 Itoh et al.
5,758,483 A 6/1998 Phillips et al.
5,783,505 A 7/1998 Ducket et al.
5,856,006 A 1/1999 Asai et al.
5,911,224 A 6/1999 Berger
5,913,311 A 6/1999 Ito et al.
5,947,126 A 9/1999 Wilson
5,970,988 A 10/1999 Buchanan et al.
5,997,790 A 12/1999 Vos et al.
6,062,228 A 5/2000 Loercks et al.
6,076,346 A 6/2000 Nakayama et al.
6,080,457 A 6/2000 Charlton et al.
6,087,465 A 7/2000 Seppälä et al.
6,344,239 B1 2/2002 Asai et al.
6,370,858 B1 4/2002 Mori
6,571,802 B1 6/2003 Yamashita
6,595,217 B1 7/2003 Case et al.
6,706,361 B1 3/2004 Ecomony et al.
6,739,344 B2 5/2004 Yamashita
6,984,631 B2 1/2006 Aranishi et al.
7,152,288 B1 12/2006 Sanderson et al.
7,223,376 B2 5/2007 Panter et al.
7,435,208 B2 10/2008 Garthaffner
7,484,511 B2 2/2009 Jupe et al.
8,177,938 B2 5/2012 Sumnicht
8,434,498 B2 5/2013 Sebastian
8,613,284 B2 12/2013 Hutchens
8,720,450 B2 5/2014 Sebastian
8,973,588 B2 3/2015 Sebastian et al.
9,179,709 B2 11/2015 Sebastian
2002/0148478 A1* 10/2002 Pera ..... A24D 3/14 131/341
2002/0182690 A1* 12/2002 Cannon ..... C12N 15/52 435/135
2003/0200973 A1 10/2003 Xue et al.
2003/0213496 A1 11/2003 Wolff et al.
2005/0011529 A1 1/2005 Horn et al.
2006/0201524 A1 9/2006 Zhang et al.
2006/0231113 A1 10/2006 Newbery et al.
2007/0143976 A1 6/2007 Sommer
2008/0029114 A1* 2/2008 Seitert ..... A24D 3/048 131/335
2008/0149119 A1 6/2008 Marquez et al.
2008/0173320 A1* 7/2008 Dunlap ..... A24D 1/00 131/365
2008/0295852 A1 12/2008 Riepert et al.
2009/0032037 A1 2/2009 Xue et al.
2009/0047857 A1 2/2009 Chang et al.
2009/0151738 A1 6/2009 Robertson et al.
2009/0288669 A1 11/2009 Hutchens
2009/0288672 A1 11/2009 Hutchens
2010/0294288 A1 11/2010 Sampson et al.
2011/0023900 A1* 2/2011 Clarke ..... A24D 3/0208 131/332
2011/0036366 A1 2/2011 Sebastian
2011/0094526 A1 4/2011 Marshall et al.
2011/0244499 A1 10/2011 Realff et al.
2011/0247609 A1 10/2011 Bansal et al.
2012/0000477 A1 1/2012 Sebastian et al.
2012/0000479 A1 1/2012 Sebastian et al.
2012/0000480 A1 1/2012 Sebastian et al.
2012/0017925 A1 1/2012 Sebastian et al.
2012/0024304 A1 2/2012 Sebastian
2013/0047999 A1* 2/2013 Rushforth ..... A24D 3/061 131/332
2013/0074853 A1 3/2013 Sebastian et al.
2014/0026909 A1* 1/2014 Sebastian ..... A24D 3/063 131/332
2014/0096783 A1* 4/2014 Sebastian ..... A24D 3/0204 131/332
2015/0107613 A1 4/2015 Lewis et al.
2015/0111452 A1* 4/2015 Dugan ..... D01F 1/10 442/202
2015/0189913 A1* 7/2015 Binassi ..... A24D 3/068 131/332
2015/0329707 A1* 11/2015 Roggenstein ..... D01F 2/10 442/327
2017/0360087 A1* 12/2017 Papakyrillou ..... A24D 3/10

FOREIGN PATENT DOCUMENTS

WO WO 2009/000453 12/2008
WO WO 2009/093051 7/2009
WO WO-2014009498 A1 * 1/2014 ..... A24D 3/068
WO WO-2014090665 A1 * 6/2014 ..... D01F 2/10
WO WO-2016108119 A1 * 7/2016 ..... A24D 3/10

(56) References Cited

OTHER PUBLICATIONS

Puls et al., "Degradation of Cellulose Acetate-Based Materials: A Review," *J Polym Environ*, 2011, pp. 152-165, vol. 19.

* cited by examiner

STAPLE FIBER BLEND FOR USE IN THE MANUFACTURE OF CIGARETTE FILTER ELEMENTS

FIELD OF THE DISCLOSURE

The present disclosure relates to products made or derived from tobacco or other smokable material that are intended for human consumption. In particular, the disclosure relates to filter elements for smoking articles such as cigarettes, and related methods for producing filter elements.

BACKGROUND

Popular smoking articles, such as cigarettes, may have a substantially cylindrical rod-shaped structure and may include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Typically, the filter element is attached to one end of the tobacco rod using a circumscribing wrapping material known as "tipping material." It also may be desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

After use, the discarded portion of the cigarette is primarily composed of the filter element, which typically consists of tightly-compacted and highly crimped cellulose acetate fibers bonded at their contact points and wrapped by the plug wrap and tipping material. The presence of the wrapping materials, the fiber-to-fiber bonding, and the compacted nature of conventional filter elements has a detrimental effect on the rate of degradation of cigarette filters in the environment. Unless the filter element is unwrapped and the fibers spread apart to increase exposure, biodegradation of the filter can take several years.

Cellulose is a known biodegradable fiber which is capable of aerobic and/or anaerobic degradation in a variety of environments. However, cellulose has traditionally not been used for the production of fibrous tow for filter elements, due in large part to the poor taste of cigarette smoke associated with cellulose-based filter elements as compared with traditional cellulose-acetate-based filter elements. It is believed that the traditionally-used cellulose acetate is advantageous in providing acetate groups that can interact with and remove certain undesirable phenolic compounds from the vapor phase of cigarette smoke. Cellulose does not have acetate groups on the fiber surface and it is believed that this may contribute to the poor taste associated with cellulose-based filters. Surface acetylation of cellulose and other types of fibers to address this issue has been proposed. See, for example, U.S. Pat. No. 4,085,760 to Toyoshima. However, there is no commercial process available for surface acetylation, which generally requires long reaction times and/or toxic chemicals.

Certain filter elements for cigarettes have been developed which contain materials that may promote biodegradation of filter elements following use. For example, certain additives have been noted (e.g., water soluble cellulose materials, water soluble fiber bonding agents, starch particles, photoactive pigments, and/or phosphoric acid) which can be added to filter materials to enhance degradability. See, for example, U.S. Pat. No. 5,913,311 to Ito et al.; U.S. Pat. No. 5,947,126 to Wilson et al.; U.S. Pat. No. 5,970,988 to Buchanan et al.; and U.S. Pat. No. 6,571,802 to Yamashita; and US Pat. Appl. Publ. Nos. 2009/0151735 to Robertson and 2011/0036366 to Sebastian. In some cases, conventional cellulose acetate filter material has been replaced with other materials, such as moisture disintegrative sheet materials, extruded starch materials, or polyvinyl alcohol. See U.S. Pat. No. 5,709,227 to Arzonico et al; U.S. Pat. No. 5,911,224 to Berger; U.S. Pat. No. 6,062,228 to Loercks et al.; and U.S. Pat. No. 6,595,217 to Case et al. It has also been suggested that the incorporation of slits into a filter element may enhance biodegradability, as described in U.S. Pat. No. 5,947,126 to Wilson et al. and U.S. Pat. No. 7,435,208 to Garthaffner. Biodegradability has also been proposed to be imparted by use of certain adhesives, such as described in U.S. Pat. No. 5,453,144 to Kauffman et al. and US Pat. Appl. Publ. 2012/0000477 to Sebastian et al. Another possible means for enhancing biodegradability is replacing the conventional cellulose acetate filter material with a core of a fibrous or particulate cellulose material coated with a cellulose ester, as described in U.S. Pat. No. 6,344,349 to Asai et al.

Further advancements in filter elements and methods for producing the same are desirable. Particularly, additional methods for enhancing the biodegradability of filter elements for preparing such filters having enhanced biodegradability are desirable.

SUMMARY OF THE DISCLOSURE

In one aspect, a method for forming a fibrous bundle suitable for use in a cigarette filter element is provided. Advantageously, the method may be such that it provides a filter element having enhanced biodegradability in comparison to traditional cellulose acetate tow-based filter elements, while retaining the desirable organoleptic properties associated with cellulose acetate filters.

In various embodiments, a method for forming a fibrous bundle suitable for use in a filter element for a smoking article can comprise blending a first plurality of cellulose acetate staple fibers with a second plurality of staple fibers to give a fiber mixture, wherein the second plurality of staple fibers can be cellulose staple fibers treated to increase hydrophobicity, and wherein the staple fibers of the fiber mixture are randomly oriented. The staple fibers of the fiber mixture can be bonded to form a fibrous bundle. The bonding step can comprise treating the fiber mixture with a plasticizer. The methods of the present invention can further comprise incorporating the fibrous bundle into a filter element for a smoking article. In some embodiments, the filter element can comprise a rapidly disintegrating plug wrap for improved biodegradation.

In various embodiments of the methods described herein, the fiber mixture can have a carbon to nitrogen ratio of about 20-40:1. The fiber mixture can comprise nitrogen containing additives to increase the carbon to nitrogen ratio. In some embodiments, the method can further comprise blending cut tobacco with the fiber mixture. An additive to improve flavor can be added to the cut tobacco. An additive to improve flavor can be added to at least one of the first plurality of cellulose acetate staple fibers and the second plurality of staple fibers.

In some embodiments, the second plurality of staple fibers can comprise a degradable material selected from the group consisting of calcium alginate, aliphatic polyesters, cellulose acetate with imbedded starch particles, cellulose coated with acetyl groups, polyvinyl alcohol, starch, polybutylene succinate, proteins, polysaccharides, and copolymers and blends thereof. In certain embodiments, the second plurality of staple fibers can be polyhydroxyalkanoate (PHA) staple fibers. The PHA can be derived from the group consisting of canola oil, tobacco seeds, and combinations thereof, for example. In some embodiments, the second plurality of staple fibers can be degradable staple fibers treated to increase hydrophobicity comprising a viscose fiber having covalently bound water repellent hydrocarbon chains inside the fiber.

In various embodiments, the weight ratio of the first plurality of cellulose acetate staple fibers to the second plurality of staple fibers can be about 25:75 to about 75:25. The first plurality of cellulose acetate staple fibers and the second plurality of staple fibers can have lengths in the range of about ⅛ inch to about 2 inches. In a preferred embodiment, the first plurality of cellulose acetate staple fibers and the second plurality of staple fibers can have lengths of about ⅜ inch or greater.

In various embodiments of the present invention, the methods described herein can further comprise blending a third plurality of staple fibers with the first plurality of cellulose acetate staple fibers and the second plurality of staple fibers to form the fiber mixture. The third plurality of staple fibers can comprise a degradable polymeric material selected from the group consisting of proteins, polysaccharides and combinations thereof, for example.

A filter element is also provided herein, wherein the filter element can comprise a first plurality of cellulose acetate staple fibers blended with a second plurality of staple fibers to give a fiber mixture, wherein the second plurality of staple fibers is cellulose staple fibers or degradable staple fibers treated to increase hydrophobicity, and wherein the staple fibers of the fiber mixture are randomly oriented. The filter element can exhibit a degradation rate that is at least about 50% faster than that of a traditional cellulose acetate filter element. Features of the methods described herein can also be included in the filter elements of the present invention. A cigarette can also be provided comprising a rod of smokable material and a filter element according to the present invention attached thereto.

Other aspects and advantages of the present invention will become apparent from the following.

BRIEF DESCRIPTION OF THE DRAWINGS

In order to assist the understanding of embodiments of the disclosure, reference will now be made to the appended drawings, which are not necessarily drawn to scale. The drawings are exemplary only, and should not be construed as limiting the disclosure.

DETAILED DESCRIPTION OF THE PREFERRED EMBODIMENTS

Figure 1:
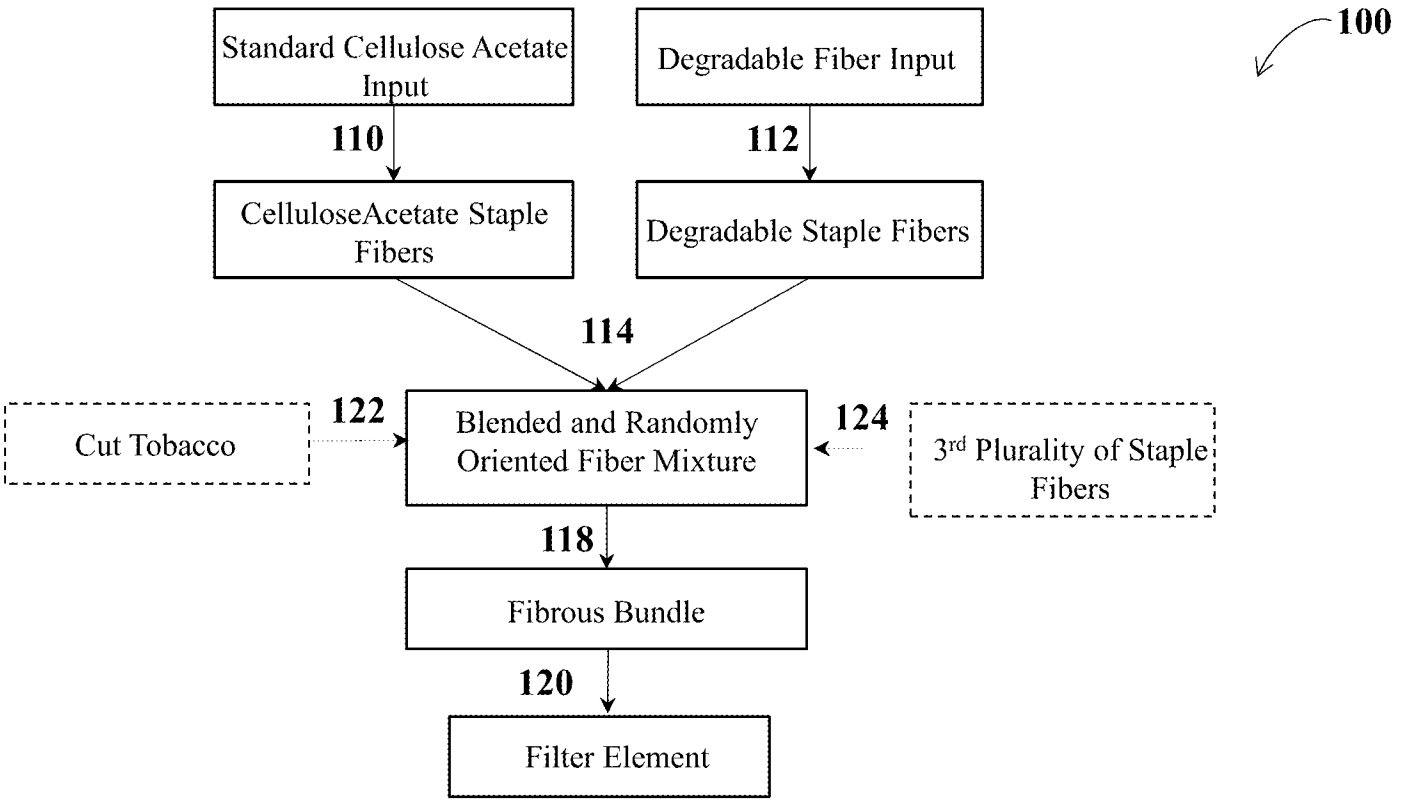
FIG. 1 is a block diagram of a method for forming a cigarette filter element according to an example embodiment.

The present disclosure now will be described more fully hereinafter with reference to the accompanying drawings. The disclosure may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural references unless the context clearly dictates otherwise.

As described herein, embodiments of the disclosure relate to products comprising multiple staple fiber types, configured for use in the manufacture of cigarette filter elements and methods for the production thereof. By way of comparison, in the traditional production of cigarettes, one tow fiber is typically employed to form the filter element. A mixed tow fiber, as used herein, refers to a substantially untwisted bundle of two or more substantially continuous filaments of a fiber, each of the two or more substantially continuous filaments of a fiber having a different composition. The material composition of the filaments forming the tow fiber may vary depending on the desired characteristics of the filter element to be produced from the tow fiber. For example, the filaments forming the tow fiber may comprise cellulose acetate, which may be employed for desirable taste and filtering characteristics associated therewith. Filaments forming a second tow fiber input and/or mixed with the cellulose acetate fibers of the first tow fiber may comprise pure cellulose for increased biodegradability, for example.

Accordingly, provided herein are methods for improved filter elements that incorporate two or more staple fiber types that may exhibit differing characteristics. In particular, in certain embodiments, the present disclosure provides a means by which two or more dissimilar fiber types can be incorporated within a filter element by providing the two or more fiber types in cut staple fiber form, blending the cut staple fibers, and forming the cut staple fibers into a fiber mixture, wherein the staple fibers of the fiber mixture are randomly oriented. The fibrous mixture can then be incorporated into a filter element for a smoking article.

In some embodiments, the two or more pluralities of staple fibers can be characterized as exhibiting different levels of biodegradability or other characteristics. By combining such fibers in the same filter element using the methods of the present disclosure, the overall level of biodegradability of the filter element can be adjusted to a desired level. Examples of combinations of fiber types exhibiting different characteristics can be found, for example, in U.S. Pat. No. 8,720,450 to Sebastian et al., which is incorporated by reference herein in its entirety. In some embodiments, by combining different fiber types in the same filter element using the methods of the present disclosure, the filter element incorporated within a cigarette can achieve the desired function (e.g., desired level of biodegradability) while providing the user with acceptable taste characteristics typically associated with traditional cellulose acetate-based filter elements.

As described herein, a filter plug comprising staple fibers can be produced from a fibrous input. The fibrous input can comprise, for example, a continuous filamentary tow, dual or multi-chemistry slivers made from separate staple fibers, or combinations thereof. As used herein, a sliver is a bundle of fibers aligned such that they are generally relatively parallel to one another (and thus has been subjected to a carding process). The fibers within the bundle are typically loosely assembled. In the present invention, two or more different fibrous inputs can be converted into staple fibers that can be incorporated into a filter element. The two or more fibrous inputs can include filamentary tows of the same chemistry, dual or multi-chemistry filamentary tows, or dual or multi-chemistry slivers.

In this regard, FIG. 1 illustrates an example embodiment of a method 100 configured to produce filter elements, with operations performed by the method illustrated schematically. In particular, the method 100 is configured to receive two or more fibrous input types (e.g., a continuous filament tow), cut the fibrous inputs into staple fibers, blend the staple fibers, and form a blended fiber mixture from the two or more types of cut staple fibers, wherein the staple fibers of the fiber mixture are randomly oriented. The fiber mixture may be employed in the formation of filter elements, which may then be incorporated into cigarettes or other smoking articles. Although the method 100 is illustrated as including sequential operations, it is to be understood that the operations need not necessarily occur in the order shown. For example, in some embodiments, the two or more different filamentary inputs can be blended before converting the inputs into staple fibers. In certain embodiments, plasticizer can be applied to one or more of the fibrous inputs, one or more of the pluralities of staple fibers, and/or to the randomly oriented fiber mixture. Further, the method may include fewer or a greater number of operations in some embodiments.

The method 100 of FIG. 1 may be configured to receive inputs of two (or more) fibrous tows and/or slivers. Fibrous tows are well known in the art and are understood to be groupings of extruded filaments that are longitudinally aligned in a substantially parallel orientation. The tows can be prepared by various techniques known in the art and can, in certain embodiments, be stored in bales and withdrawn therefrom for use according to the present invention. In some embodiments, the fibrous tow inputs can be raw and/or untreated, meaning that they can be unbonded/unplasticized, and can be crimped or uncrimped prior to use. Although the following discussion relates to fibrous tows as starting materials, it is not necessary that the staple fibers used in the present invention originate from a fibrous tow material. Staple fibers derived from any method known in the art can be used in embodiments of the present invention.

Generally, one of the fiber inputs comprises standard cellulose acetate tow and one of the fiber inputs comprises a different type of tow. For example, in certain embodiments, the second fiber input comprises a cellulose material treated to increase hydrophobicity and/or a degradable (e.g., biodegradable) fiber-based tow. The term "biodegradable" as used in reference to a degradable polymer refers to a polymer that degrades under aerobic and/or anaerobic conditions in the presence of bacteria, fungi, algae, and/or other microorganisms into carbon dioxide/methane, water and biomass, although materials containing heteroatoms can also yield other products such as ammonia or sulfur dioxide. "Biomass" generally refers to the portion of the metabolized materials incorporated into the cellular structure of the organisms present or converted to humus fractions indistinguishable from material of biological origin.

Biodegradability can be measured, for example, by placing a sample in environmental conditions expected to lead to decomposition, such as placing a sample in water, a microbe-containing solution, a compost material, or soil. The degree of degradation can be characterized by weight loss of the sample over a given period of exposure to the environmental conditions. Exemplary rates of degradation for certain filter element embodiments of the invention include a weight loss of at least about 20% after burial in soil for 60 days or a weight loss of at least about 30% after 15 days of exposure to a typical municipal composter. However, rates of biodegradation can vary widely depending on the type of degradable materials used, the remaining composition of the filter element, and the environmental conditions associated with the degradation test. U.S. Pat. No. 5,970,988 to Buchanan et al. and U.S. Pat. No. 6,571,802 to Yamashita provide exemplary test conditions for degradation testing, each of which is incorporated by reference herein. The degradability of a plastic material also may be determined using one or more of the following ASTM test methods: D5338, D5526, D5988, and D6400.

Exemplary biodegradable materials that can be used in a fibrous form in the present invention include aliphatic polyesters, cellulose acetate with imbedded starch particles, cellulose coated with acetyl groups, polyvinyl alcohol, starch, polybutylene succinate, proteins, polysaccharides (e.g., cellulose and/or calcium alginate), and copolymers and blends thereof. Additional examples of biodegradable materials include thermoplastic cellulose, available from Toray Industries, Inc. of Japan and described in U.S. Pat. No. 6,984,631 to Aranishi et al., which is incorporated by reference herein, and thermoplastic polyesters such as Ecoflex® aliphatic-aromatic copolyester materials available from BASF Corporation or poly(ester urethane) polymers described in U.S. Pat. No. 6,087,465 to Sepp älä et al., which is incorporated by reference herein in its entirety. Any of these biodegradable fibers can further include a cellulose acetate coating on the outer surface thereof.

Exemplary aliphatic polyesters advantageously used in the present invention have the structure —[C(O)—R—O]$_n$—, wherein n is an integer representing the number of monomer units in the polymer chain and R is an aliphatic hydrocarbon, preferably a C1-C10 alkylene, more preferably a C1-C6 alkylene (e.g., methylene, ethylene, propylene, isopropylene, butylene, isobutylene, and the like), wherein the alkylene group can be a straight chain or branched. Exemplary aliphatic polyesters include polyglycolic acid (PGA), polylactic acid (PLA) (e.g., poly(L-lactic acid) or poly(DL-lactic acid)), polyhydroxyalkanoates (PHAs) such as polyhydroxypropionate, polyhydroxyvalerate, polyhydroxybutyrate, polyhydroxyhexanoate, and polyhydroxyoctanoate, polycaprolactone (PCL), polybutylene succinate, polybutylene succinate adipate, and copolymers thereof (e.g., polyhydroxybutyrate-co-hydroxyvalerate (PHBV)). In various embodiments, the biodegradable fibrous tow input comprises a polyhydroxyalkanoate (PHA). In certain embodiments, the PHA can be derived from fermentation of sugar, or fermentation of fatty acids derived from canola seed oil, tobacco seed oil, or blends of these oils. For example, sugar derived PHA can be purchased from Metabolix®, located in Cambridge, Mass. Fatty acid derived PHA can be purchased, for example, from DaniMer Scientific of Meridian Holdings, located in Bainbridge, Ga.

Various other degradable materials suitable for use in the present invention are set forth, for example, in U.S. Pat. No. 8,613,284 to Hutchens, U.S. Pat. No. 8,434,498 to Sebastian, U.S. Pat. No. 8,720,450 to Sebastian, and U.S. Pat. No. 8,973,588 to Sebastian et al., and US Pat. Pub. No. 2012/0000479 to Sebastian et al., each of which is incorporated by reference herein.

In preferred embodiments, the biodegradable fibrous tow input comprises cellulose (e.g., rayon). Cellulose can be natural or processed. In certain embodiments, cellulose as used herein may refer to regenerated cellulose fibers. Regenerated cellulose fibers are typically prepared by extracting non-cellulosic compounds from wood, contacting the extracted wood with caustic soda, followed by carbon disulfide and then by sodium hydroxide, giving a viscous solution. The solution is subsequently forced through spinneret heads to create viscous threads to give regenerated fibers. Exemplary methods for the preparation of regenerated cellulose are provided in U.S. Pat. No. 4,237,274 to Leoni et al; U.S. Pat. No. 4,268,666 to Baldini et al; U.S. Pat. No. 4,252,766 to Baldini et al.; U.S. Pat. No. 4,388,256 to Ishida et al.; U.S. Pat. No. 4,535,028 to Yokogi et al.; U.S. Pat. No. 5,441,689 to Laity; U.S. Pat. No. 5,997,790 to Vos et al.; and U.S. Pat. No. 8,177,938 to Sumnicht, which are incorporated herein by reference. Various suppliers of regenerated cellulose are known, including Lenzing AG (Austria).

For use in the present invention, cellulose fibers in certain embodiments are advantageously treated to provide a secondary finish that imparts acetyl functionality to the fiber surface. Coated cellulose fibers can be provided, for example, using methods as outlined in US Pat. Appl. Pub. Nos. 2012/0017925; 2012/0000480; and 2012/0000479, all to Sebastian et al, which are incorporated herein by reference. The combination of cellulose acetate and cellulose fibers is particularly beneficial as the biodegradation rate of cellulose acetate and cellulose fibers has been shown to be greater than the sum of individual fiber degradation rates (i.e., the mixture biodegrades in a synergistic fashion). See U.S. Pat. No. 5,783,505 to Ducket et al., which is incorporated herein by reference. In certain embodiments, filter elements of the present invention exhibit a degradation rate that is at least about 50% faster than that of a traditional cellulose acetate filter element.

In certain embodiments you can use additional fiber inputs, such that there are three or more staple fiber input types (e.g., three, four, five, six, etc. fiber input types). By way of example, cotton and/or regenerated cellulose having ion exchange groups introduced thereto may be employed, for example, as an ion-exchange fiber configured for vapor absorption. Activated carbon fibers may also be employed for improved particle filtration and/or improved vapor absorption. By way of further example, a second biodegradable fibrous tow input (as described in more detail above) can be selected for improved biodegradability, such that two different biodegradable staple fiber types are included in the fibrous mixture. The fibers may include any other fibers, which may be selected for improved biodegradability, improved particulate filtration, improved vapor absorption, and/or any other beneficial aspect associated with the fibers. For further examples, see the material compositions set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al.; and U.S. Pat. No. 5,271,419 to Arzonico et al.; each of which is incorporated herein by reference. Thereby, for example, the aspects of cellulose acetate that may be desirable (e.g., taste and filtration) may be retained while offering other functionality (e.g., improved biodegradability, improved particulate filtration, and/or improved vapor absorption).

In preferred embodiments, the biodegradable fibrous tow input, and/or the staple fibers derived therefrom, can be treated to increase hydrophobicity. Without being limited by theory, hydrophobic fibers can be useful in maintaining a favorable smoke chemistry, at least with respect to moisture. For example, cellulose fibers can absorb moisture, as compared to cellulose acetate fibers, and thereby lead to a drier smoke. However, cellulose fibers that have been treated to increase hydrophobicity, can advantageously function similar to cellulose acetate fibers with respect to the absorption of moisture. In various embodiments, the biodegradable material for use in the present invention can comprise a viscose fiber with incorporated hydrophobicity based on covalently bound water repellent hydrocarbon chains inside the fibers. For example, in certain embodiments the biodegradable material for use in the present invention can be Olea® fibers (available from Kelheim Fibres). In some embodiments, the fibrous input can comprise 100 percent of a cellulose material treated to increase hydrophobicity (i.e., the first plurality of staple fibers can also comprise a cellulose material treated to increase hydrophobicity).

The fiber inputs can have various physical properties. For example, fiber tow inputs can have any total denier (i.e., weight in grams of a 9000 meter length of uncrimped tow). According to the present invention, the total denier of the tow input material is not critical, as the tow will be cut as desired. This aspect of the invention is particularly beneficial as certain materials (e.g., regenerated cellulose tow) are not widely available in typical required ranges for filter element production equipment. Exemplary total denier values for fiber tow inputs can vary depending on the particular input; for example, cellulose acetate tow can be commonly found with a total denier of from about 10,000 to about 100,000 (e.g., about 35,000) and cellulose tow is commonly found in much larger sizes (e.g., greater than about 80,000 or greater than about 100,000 denier).

Other characteristics of the fiber inputs include the denier of individual fibers thereof (denier per filament, i.e., "dpf"). Denier per filament is a measurement of the weight per unit length of the individual filaments of the fibers and can be manipulated to achieve a desired pressure drop across the filter element produced from the fibers. An exemplary dpf range for the filaments comprising the fibrous tow inputs may be about 1 to about 10 where denier is expressed in units of grams/9000 meters, although larger and smaller filaments can be used without departing from the invention. The shapes of the individual filament cross-sections can also vary and may include, but are not limited to, multilobal (e.g., exhibiting a shape such as an "X," "Y," "H," "I," or "C" shape), rectangular, circular, or oblong.

The relative amounts of each fibrous input type utilized according to the methods of the invention can vary. For example, the inputs can be in roughly equal proportions by weight, giving a final product comprising about 1:1 cellulose acetate material: degradable material. In some embodiments, the inputs can be different, such that greater than 50% of the input comprises cellulose acetate material or such that greater than 50% of the input comprises degradable material. For example, the weight ratio of cellulose acetate input to degradable input can be from about 1:99 to about 99:1, and preferably from about 25:75 to 75:25. In certain embodiments, it can be desirable to maximize the degradable input so as to maximize the degradability of the resulting product. However, maximizing the degradable input may, in certain embodiments, hinder the ability to plasticize the resulting blended fiber mixture (e.g., with triacetin). In such embodiments, therefore, a certain level of cellulose acetate is advantageously maintained to ensure sufficient plasticization.

As illustrated in FIG. 1, the standard cellulose acetate input (e.g., a cellulose acetate tow or a sliver comprising cellulose acetate) and the degradable input are each cut into a multiplicity of staple fibers via steps 110 and 112, respectively. See, e.g., the process described in U.S. Pat. No. 3,552,400 to Berger, herein incorporated by reference. The cutting can be accomplished by various means. In some embodiments, the staple fibers are cut using a chopper/cutter, rotary cutter, or guillotine cutter or by stretch breaking. Tow cutting/breaking equipment is known as disclosed for example, in U.S. Pat. No. 3,485,120 to Keith; U.S. Pat. No. 3,658,626 to Berger et al.; U.S. Pat. No. 3,915,042 to Laird; U.S. Pat. No. 4,006,277 to Laird; U.S. Pat. No. 4,141,115 to Fourne et al.; U.S. Pat. No. 4,192,041 to Sasaki et al.; and U.S. Pat. No. 4,538,490 to Becker and US Pat Appl Publ No. 2009/0047857 to Chang et al., which are incorporated herein by reference. Exemplary commercially available equipment (e.g., tow cutter/chopper) is available, for example, from DM&E (Shelby, N.C.) and Lenzing Technik (Lenzing, Austria). In certain embodiments, the lengths of the staple fibers produced depend on the relationship between the speed of the cutter and the rate at which the input is fed into the cutter. Accordingly, longer or shorter staple fibers can be provided in some embodiments by modifying the feed rate into the cutter. The lengths of the staple fibers produced via this step can vary and may be, for example, from about ⅛ inch to about 2 inches. In some embodiments, the staple fibers are from about ¼ to about 1 inches, such as about ⅜ inches. It is preferable that at least a majority portion of the staple fibers are slightly longer than the diameter of the finished filter element so that they will bend back towards the center of the filter element slightly when they extend substantially transverse to the longitudinal dimension of the finished filtration product. This will help improve the interengagement of the staple fibers. The range of staple fiber lengths produced according to this step can vary, but preferably, the staple fiber lengths are substantially uniform.

The cellulose acetate staple fibers and degradable staple fibers are blended in step 114 to give a blended and randomly oriented fiber mixture. The term randomly oriented fiber mixture means that the staple fibers are randomly oriented in three dimensions in the fibrous bundle/filter element. Various methods and equipment can be used to blend the staple fibers. Staple fibers can be hand blended and/or blended within various types of blending equipment (e.g., pickers, such as those manufactured by C.J. Sargent & Son (now part of Buhler Aeroglide Corporation, Cary, N.C.) and Davis & Furber Machine Company (originally in MA)). Advantageously, an intimate blend having a random mixture of the two or more staple fiber types is produced. Further discussion of randomly oriented fiber mixtures of the type useful in the present invention can be found in U.S. Pat. Pub. No. 2011/0023900 to Clarke et al., herein incorporated by reference in its entirety.

In various embodiments, the cut staple fibers can be blended according to a process such as the one described in U.S. Pat. No. 3,552,400 to Berger and U.S. Pat. Pub. No. 2011/0023900 to Clarke et al., herein incorporated by reference in their entireties. The staple fibers produced by a chopper can be sucked through an apparatus at the exit of the chopper to the entrance of a blower. A turbulent air stream created in the blower disperses the cut staple fibers and carries them to the exit of the blower where the air stream containing the staple fibers is blown through a porous enclosing means in the form of a frustoconical screen. The outlet end of the frustoconical screen feeds onto a porous belt. The porous enclosing means is tapered such that it slows the speed of the staple fibers passing through it. In addition, the tapered enclosing means results in a predominant portion of the staple fibers to be disposed substantially transverse to the longitudinal axis of the continuous filter element to be produced therefrom. As such, a randomly oriented fiber mixture is formed.

In various embodiments as noted above, a third (or more) plurality of staple fibers, such as a further plurality of staple fibers comprising a second degradable polymeric material, can be blended into the fiber mixture at step 124. In a preferred embodiment, the second degradable polymeric material is selected from the group consisting of proteins, polysaccharides (e.g., alginate) and combinations thereof. The third plurality of staple fibers can also be generated from a fibrous tow according to methods discussed above. When present, the third or further additional plurality of staple fibers can be present in an amount of at least about 5% by weight, at least 10% by weight or at least about 15% by weight. Typically, the further additional plurality of staple fibers is present in an amount of no more than 25% by weight.

In some embodiments, a third plurality of staple fibers can comprise a protein fiber which can be useful in raising the C/N ratio of the randomly oriented fiber mixture. The protein can be a soy or a milk protein, for example. For example, soybean protein fibers useful in the present invention are available from Harvest SPF Textile Co., Ltd. of China.

Various natural and/or artificial flavorants can also be added to the randomly oriented fiber mixture of the present invention, and the character of these flavors can be described as, without limitation, fresh, sweet, herbal, confectionary, floral, fruity or spicy. Specific types of flavors include, but are not limited to, vanilla (e.g., vanillin optionally in complexed form), coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, and strawberry. See also, Leffingwill et al., Tobacco Flavoring for Smoking Products, R. J. Reynolds Tobacco Company (1972), which is incorporated herein by reference. Flavorings also can include components that are considered moistening, cooling or smoothening agents, such as eucalyptus. Flavorings can also include sensates, which can add a range of tactile, organoleptic properties to the products. For example, sensates can provide a warming, cooling, or tingling sensation. These flavors may be provided neat (i.e., alone) or in a composite (e.g., spearmint and menthol, or orange and cinnamon). Flavorants of this type can be present in an amount of from about 0.5% to about 15%, often between about 0.5% and about 1.5% by weight of the fiber mixture. In certain embodiments, the flavorant is present in any amount of at least about 0.5% by weight or at least about 0.75% by weight of the mixture.

In various embodiments, one or more flavorants can be added to a plurality of staple fibers before the randomly fiber mixture is formed. As such, at least one flavorant can be added to at least one of the first plurality of cellulose acetate staple fibers and the second plurality of degradable polymeric staple fibers before the fiber mixture is formed through blending at step 114. In embodiments incorporating a third plurality of staple fibers, at least one flavorant can be added to the third plurality of staple fibers before blending. In certain embodiments, different flavorants can be added to each of the pluralities of staple fibers incorporated into a blended fiber mixture.

In various embodiments, a plasticizer can be added to the fiber mixture. Plasticizer is optionally applied to the blended fiber mixture and may, in certain embodiments, be applied in traditional amounts using known techniques. For example, plasticizer application may involve applying (e.g., via spraying or wick application) a plasticizer to the fiber input(s), plurality(s) of staple fiber types, fiber mixture and/or fibrous bundle to produce a plasticized fiber product. In some embodiments, one or more of the fibrous inputs can be plasticized before the input is cut into a plurality of staple fibers (e.g., at steps 110 or 112). In various embodiments, a starting input material can already have been treated with plasticizer. In certain embodiments, one or more of the pluralities of staple fiber types can be plasticized before the staple fiber types are blended into a randomly oriented fiber mixture at step 114. In various embodiments, the randomly oriented fiber mixture can be plasticized before the fiber mixture is formed into a fibrous bundle at step 118. Plasticizer application may, in some embodiments, be conducted for the purpose of ultimately bonding the staple fibers of the fiber mixture to one another to produce a relatively firm and rigid structure configured to not soften or collapse during smoking. In various embodiments, a binder material (e.g., a water soluble polymer material) can be added to one or more of the fibrous inputs, one or more of the plurality of staple fibers, the randomly oriented fiber mixture, and/or the fibrous bundle. Other suitable materials or additives used in connection with the construction of the filter element will be readily apparent to those skilled in the art of cigarette filter design and manufacture. See, for example, the discussion of plasticizers and binder materials found in U.S. Pat. No. 5,387,285 to Rivers and U.S. Pat. No. 3,552,400 to Berger; and U.S. Pat. Pub. No. 2011/0023900 to Clarke et al., herein incorporated by reference.

Various types of plasticizers are known and can be employed according to the method disclosed herein. For example, glyceryl triacetate (triacetin), carbowax, diacetates, dipropionates, and dibutyrates of triethylene glycol, tetraethylene glycol, and pentaethylene glycol; levulinic acid esters, phthalic acid esters (e.g., dimethyl phthalate, dibutyl phthalate, dioctyl phthalate), phosphoric esters (e.g., tris(β-monochloroethyl)phosphate, tris(2,3-dichloropropyl) phosphate, and tris(2,3-dibromopropyl)phosphate), and combinations thereof. In one embodiment, the plasticizer may comprise triacetin and carbowax in a 1:1 ratio by weight. The total amount of plasticizer may be generally about 4 to about 20 percent by weight, preferably about 6 to about 12 percent by weight of the filter material. The quantity of plasticizer may vary, although the present invention requires no more than, and often less than, prior art filter formation techniques.

In various embodiments, cut tobacco (or another additive) can optionally be blended into the fiber mixture at step 122. In some embodiments, the weight ratio of the cut tobacco can be about 2 to about 6 percent based on the total weight of the fiber mixture. A detailed discussion of cut tobacco and tobacco types useful in the present invention is presented below. In various embodiments, at least one flavorant can be added to the cut tobacco prior to blending.

For a biodegradable material, it can be important to balance the amount of carbon with the amount of nitrogen. The carbon to nitrogen (C/N) ratio can be used as a general parameter to describe the suitability of a given substrate for composting, or anaerobic digestion, or any other biological process. As nitrogen is an element necessary to allow for biological life, the level of nitrogen or C/N ratio can be used as an indication for the general level of nutrients compared to carbon. Balancing the C/N ratio can be important to promote optimal biological activity and thereby higher rates of biodegradation. In various embodiments, components of the fibrous bundles can be adjusted or additives can be added to achieve an optimal C/N ratio. For example, cellulose acetate and cellulose are nitrogen free. Accordingly, in embodiments incorporating cellulose acetate and cellulose, it can be useful for optimal biodegradation to include nitrogen-containing additives (e.g., cut tobacco filler, green tea, soybean flour, coffee beans, protein fibers, etc.). The nitrogen-containing additives can be in shredded or particulate form, or in the form of an extract. As discussed above, the nitrogen-containing additives can be blended into the fiber mixture at step 122, for example.

The C/N ratio of the fibrous mixture is preferably within a certain window to allow for optimal biological activity. In various embodiments, the C/N ratio of the fibrous mixture can be about 15:1 to about 50:1. In preferred embodiments, the blended fiber mixture can have a C/N ratio of about 20:1 to about 40:1.

The randomly oriented fiber mixture can undergo a bonding process at step 118 to form a fibrous bundle that can be used as a filter element. For example, as described in U.S. Pat. No. 3,553,400 to Berger, herein incorporated by reference, the porous belt can allow for various gaseous mediums (e.g., steam, air, etc.) used to treat the fiber mixture to pass through the belt and treat the fiber mixture in a substantially uniform manner across the entire cross-section of the fiber mixture. Preferably, the pores of the belt are smaller than any of the staple fibers. After the staple fibers have been fed onto the porous belt, the belt can be formed around the staple fibers in a substantially closed circular cross-section through the use of a bore on a similar apparatus. The closed belt can then pass through a steam treatment station, for example. Steam can then pass through the porous belt and activate the bonding constituents of the staple fibers while the fibers are carried by the belt. The belt carrying the bonded fibers can then pass through a cooling station to cool and set or cure the previously activated bonding constituents and to remove excess moisture from the material. The continuous staple fiber product can then be peeled from the belt as it leaves the cooling station and subsequently cut to a desired length by cutting means to form segments that can be used as filter elements in a smoking article, for example. See also, e.g., U.S. Pat. Pub. No. 2015/0107613 to Lewis, herein incorporated by reference.

A fibrous bundle of the present invention generally must have a certain degree of strength (e.g., tensile strength and/or tenacity) to be capable of being subjected to the subsequent processing steps traditionally employed for the production of cigarette filters. For example, in some embodiments, a breaking strength of at least about 15 pounds is useful. In some cases, the fibrous bundle prepared as described above inherently has sufficient strength such that it can be directly subjected to step 120, incorporation into a filter element.

It can, in certain embodiments, be advantageous to optimize one or more steps of the fibrous bundle production process and/or to add additional steps to the fibrous bundle production process in order to enhance the breaking strength of the fibrous bundle. Enhanced strength can, in some embodiments, allow the fibrous bundle to be directly processed on conventional filter making machinery. For example, in some embodiments, a breaking strength of between about 10 and about 20 lbs (about 4500 g to about 9100 g), such as at least about 10 lbs (about 4500 g) or at least about 15 lbs (about 6800 g) is desirable.

In some embodiments, as noted above, the fibrous bundle is strengthened prior to being incorporated into a filter element. In certain embodiments, the fibrous bundle can be strengthened directly and then incorporated into a filter element in step 120. In some embodiments, the fibrous bundle may be strengthened such that it can be subjected to traditional processing (e.g., high speed processing) for the production of filter elements with little or no adaptations to accommodate the fibrous bundle. Numerous methods are known for strengthening such a material. In certain exemplary embodiments, the strengthening can comprise air entangling, core yarn insertion, textured yarn insertion, partial plasticization, or a combination thereof, although other methods that can function to strengthen the fibrous bundle are also intended to be encompassed herein.

The fibrous bundle is incorporated within a filter element via step 120. This step can be accomplished by traditional techniques known in the art, such as those described, for example, in U.S. Pat. No. 3,552,400 to Berger; and U.S. Pat Appl. Pub. Nos. 2011/0023900 to Clarke et al. and 2013/0074853 to Sebastian et al., which are incorporated herein by reference. In certain embodiments, the mixed fibrous bundle can be subjected to one or more rod making operations, which may include shaping of the mixed fibrous bundle. For example, the mixed fibrous bundle may be compressed or otherwise shaped to form a continuous cylindrical rod shape. In various embodiments, the continuous cylindrical rod shaped fibrous bundle can be wrapped with a plug wrap material.

The rod making operations may additionally include cutting the mixed fibrous bundle into segments. In this regard, the fibrous bundle may be longitudinally subdivided into cylindrical shaped filter segments. In some embodiments the length of the filter segments may be selected based on a desired length of the filter element for a single cigarette. By way of further example, in another embodiment the filter segments may be cut to lengths which are equivalent to two times the length of the filter element for a single cigarette, and the filter segment may be cut in two at a later time. For example, the filter segment may connect two rods of tobacco, and the filter segment may be divided to form the filters for two cigarettes.

The measurements of filter segments depend on the particular application thereof, but typically filter segments for cigarettes may range in length from about 80 mm to about 140 mm, and from about 16 mm to about 27 mm in circumference. For example, a typical filter segment having a 100 mm length and a 24.53 mm circumference may exhibit a pressure drop of from about 200 mm to about 400 mm of water as determined at an airflow rate of 17.5 cubic centimeters per second (cc/sec.) using an encapsulated pressure drop tester, sold commercially as Model No. FTS-300 by Filtrona Corporation, Richmond, Va.

The mixed fibrous bundle may be wrapped with the plug wrap such that each end of the filter material remains exposed. The plug wrap can vary. See, for example, U.S. Pat. No. 4,174,719 to Martin, which is incorporated herein by reference. Typically, the plug wrap is a porous or non-porous paper material. Suitable plug wrap materials are commercially available. Exemplary plug wrap papers ranging in porosity from about 1100 CORESTA units to about 26000 CORESTA units are available from Schweitzer-Maudit International as Porowrap 17-M1, 33-M1, 45-M1, 70-M9, 95-M9, 150-M4, 150-M9, 240M9S, 260-M4 and 260-M4T; and from Miquel-y-Costas as 22HP90 and 22HP150. Non-porous plug wrap materials typically exhibit porosities of less than about 40 CORESTA units, and often less than about 20 CORESTA units. Exemplary non-porous plug wrap papers are available from Olsany Facility (OP Paprina) of the Czech Republic as PW646; Wattenspapier of Austria as FY/33060; Miquel-y-Costas of Spain as 646; and Schweitzer-Mauduit International as MR650 and 180. Plug wrap paper can be coated, particularly on the surface that faces the mixed fibrous bundle, with a layer of a film-forming material. Such a coating can be provided using a suitable polymeric film-forming agent (e.g., ethylcellulose, ethylcellulose mixed with calcium carbonate, nitrocellulose, nitrocellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials. In various embodiments, the plug wrap can be a rapidly disintegrating material such that the biodegradation of the filter element is improved.

If desired, so-called "non-wrapped" filter segments may also be produced. Such segments are produced using the types of techniques generally set forth herein. However, rather than employing a plug wrap that circumscribes the longitudinally extending periphery of the filter material, a somewhat rigid rod is provided, for example, by applying steam to the shaped mixed fibrous bundle. Techniques for commercially manufacturing non-wrapped filter rods are possessed by Filtrona Corporation, Richmond, Va.

Accordingly, shaped, cut, and/or wrapped (or non-wrapped) filter elements may be produced by the rod making operation(s). The method 100 may be further incorporated within a larger cigarette making operation. The cigarette making operations may include wrapping a supply of smokable material with a wrapping material to form a smokable rod.

Cigarette making operations used in combination with the filter preparation process 100 shown in FIG. 1 and described above may be conducted using a conventional automated cigarette rod making machine. Generally, automated cigarette making machines provide a formed continuous cigarette rod (or other smokable rod) that can be subdivided into formed smokable rods of desired lengths. The components and operation of conventional automated cigarette making machines will be readily apparent to those skilled in the art of cigarette making machinery design and operation. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,131,416 to Gentry; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and US Pat. Appl. Pub. Nos. 2003/0145866 to Hartman; 2004/0129281 to Hancock et al.; 2005/0039764 to Barnes et al.; and 2005/0076929 to Fitzgerald et al.; each of which is incorporated herein by reference. Descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al.; U.S. Pat. No. 4,291,713 to Frank; U.S. Pat. No. 4,574, 816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and US Pat. Appl. Pub. No. 2003/0136419 to Muller; each of which is incorporated herein by reference.

Filter elements produced in accordance with this disclosure may be incorporated within conventional cigarettes configured for combustion of a smokable material, and also within the types of cigarettes set forth in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 to Beven; which are incorporated herein by reference. Still further, filter elements produced in accordance with the description provided above may be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference. Other examples of non-traditional cigarettes, commonly referred to as "e-cigarettes", which could incorporate a filter element of the present invention, include U.S. Pat. No. 7,726,320 to Robinson et al. and U.S. Pat. No. 8,079,371 to Robinson et al., and U.S. Pat. Appl. Pub. Nos. 2013/0037041 to Worm et al., 2013/0255702 to Griffith Jr. et al., and 2014/0000638 to Sebastian et al., all of which are incorporated by reference herein.

The smokable material employed in manufacture of the smokable rod can vary. For example, the smokable material can have the form of filler (e.g., such as tobacco cut filler). As used herein, the terms "filler" or "cut filler" are meant to include tobacco materials and other smokable materials which have a form suitable for use in the manufacture of smokable rods. As such, filler can include smokable materials which are blended and are in a form ready for cigarette manufacturer. The filler materials normally are employed in the form of strands or shreds as is common in conventional cigarette manufacture. For example, the cut filler material can be employed in the form of strands or shreds from sheet-like or "strip" materials which are cut into widths ranging from about 1/20 inch to about 1/60 inch, preferably from about 1/25 inch to about 1/35 inch. Generally, such strands or shreds have lengths which range from about 0.25 inch to about 3 inches.

Examples of suitable types of tobacco materials include flue-cured, Burley, Md. or Oriental tobaccos, rare or specialty tobaccos, and blends thereof. The tobacco material can be provided in the form of tobacco lamina; processed tobacco, processed tobacco stems such as cut-rolled or cut-puffed stems, reconstituted tobacco materials; or blends thereof. The smokable material or blend of smokable materials may consist essentially of tobacco filler material. Smokable materials can also be cased and top dressed as is conventionally performed during various stages of cigarette manufacture.

Typically, the smokable rod has a length which ranges from about 35 mm to about 85 mm, preferably about 40 to about 70 mm; and a circumference of about 17 mm to about 27 mm, preferably about 22.5 mm to about 25 mm. Short cigarette rods (i.e., having lengths from about 35 to about 50 mm) can be employed, particularly when smokable blends having a relatively high packing density are employed.

The wrapping material can vary, and typically is a cigarette wrapping material having a low air permeability value. For example, such wrapping materials can have air permeabilities of less than about 5 CORESTA units. Such wrapping materials include a cellulosic base web (e.g., provided from wood pulp and/or flax fibers) and inorganic filler material (e.g., calcium carbonate and/or magnesium hydroxide particles). A suitable wrapping material is a cigarette paper consisting essentially of calcium carbonate and flax. Particularly preferred wrapping materials include an amount of a polymeric film forming agent sufficient to provide a desirably low air permeability. Exemplary wrapping materials 164 are P-2540-80, P-2540-81, P-2540-82, P-2540-83, P-2540-84, and P-2831-102 available from Kimberly-Clark Corporation and TOD 03816, TOD 05504, TOD 05560 and TOD 05551 available from Ecusta Corporation.

The packing densities of the blend of smokable materials contained within the wrapping materials can vary. Typical packing densities for smokable rods may range from about 150 to about 300 mg/cm$^3$. Normally, packing densities of the smokable rods range from about 200 to about 280 mg/cm$^3$.

Further, the cigarette making operations may include attaching the mixed fibrous bundle filter element to the smokable rod. For example, the filter element and a portion of the smokable rod may be circumscribed by a tipping material with an adhesive configured to bind to the filter element and the tobacco rod so as to couple the mixed fibrous bundle-based filter element to an end of the tobacco rod.

Typically, the tipping material circumscribes the filter element and an adjacent region of the smokable rod such that the tipping material extends about 3 mm to about 6 mm along the length of the smokable rod. Typically, the tipping material is a conventional paper tipping material. The tipping material can have a permeability which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

Accordingly, cigarettes (or other smokable articles) may be produced in accordance with the above-described example embodiments, or under various other embodiments of systems and methods for producing cigarettes. The cigarette making operations performed after production of the mixed fibrous bundle as described above may, in certain embodiments, be substantially the same as those performed in traditional methods for producing smoking articles. Thus, existing cigarette production equipment may be utilized. It is noted that the method for forming cigarettes may also include other apparatuses and components that correspond with the operations discussed above.

Figure 2:
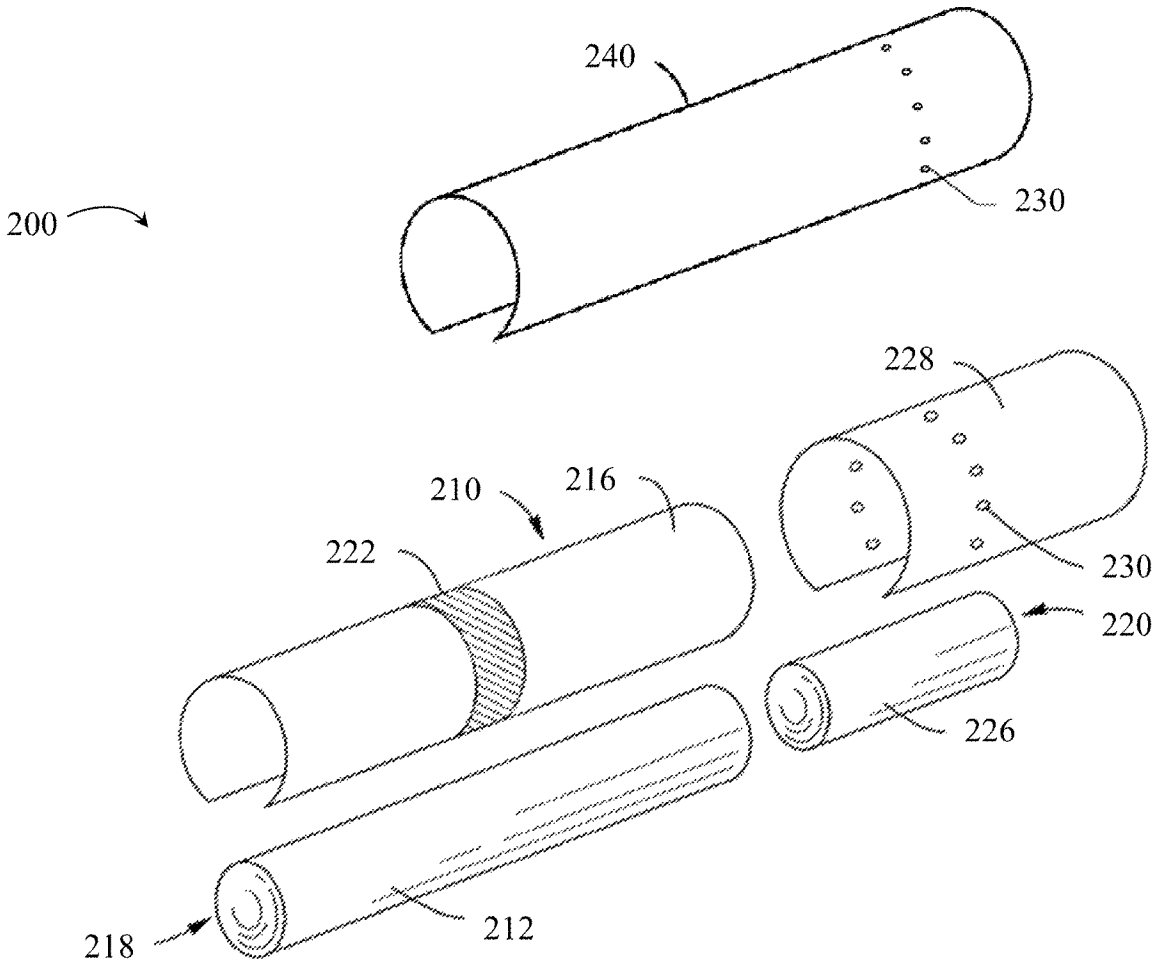
FIG. 2 is an exploded view of an example embodiment of a cigarette produced in accordance with methods disclosed herein.

FIG. 2 illustrates an exploded view of a smoking article in the form of a cigarette 200 that may be produced by the methods disclosed herein. The cigarette 200 includes a generally cylindrical rod 212 of a charge or roll of smokable filler material contained in a circumscribing wrapping material 216. The rod 212 is conventionally referred to as a "tobacco rod." The ends of the tobacco rod 212 are open to expose the smokable filler material. The cigarette 200 is shown as having one optional band 222 (e.g., a printed coating including a film-forming agent, such as starch, ethylcellulose, or sodium alginate) applied to the wrapping material 216, and that band circumscribes the cigarette rod 212 in a direction transverse to the longitudinal axis of the cigarette 200. That is, the band 222 provides a cross-directional region relative to the longitudinal axis of the cigarette 200. The band 222 can be printed on the inner surface of the wrapping material 216 (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 212 is the lighting end 218, and at the mouth end 220 is positioned a mixed fibrous bundle filter element 226. The mixed fibrous bundle filter element 226 may be produced by the methods disclosed herein. The mixed fibrous bundle filter element 226 may have a generally cylindrical shape, and the diameter thereof may be essentially equal to the diameter of the tobacco rod 212. The mixed fibrous bundle-based filter element 226 is circumscribed along its outer circumference or longitudinal periphery by a layer of outer plug wrap 228 to form a filter element. The filter element is positioned adjacent one end of the tobacco rod 212 such that the filter element and tobacco rod are axially aligned in an end-to-end relationship, preferably abutting one another. The ends of the filter element permit the passage of air and smoke therethrough.

A ventilated or air diluted smoking article can be provided with an optional air dilution means, such as a series of perforations 230, each of which extend through the tipping material 240 and plug wrap 228. The optional perforations 230 can be made by various techniques known to those of ordinary skill in the art, such as laser perforation techniques. Alternatively, so-called off-line air dilution techniques can be used (e.g., through the use of porous paper plug wrap and pre-perforated tipping material). For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette. The mixed fibrous bundle filter element 226 may be attached to the tobacco rod 212 using the tipping material 240 (e.g., essentially air impermeable tipping material), that circumscribes both the entire length of the filter element and an adjacent region of the tobacco rod 212. The inner surface of the tipping material 240 is fixedly secured to the outer surface of the plug wrap 228 and the outer surface of the wrapping material 216 of the tobacco rod, using a suitable adhesive; and hence, the filter element and the tobacco rod are connected to one another to form the cigarette 200.

Figure 3:
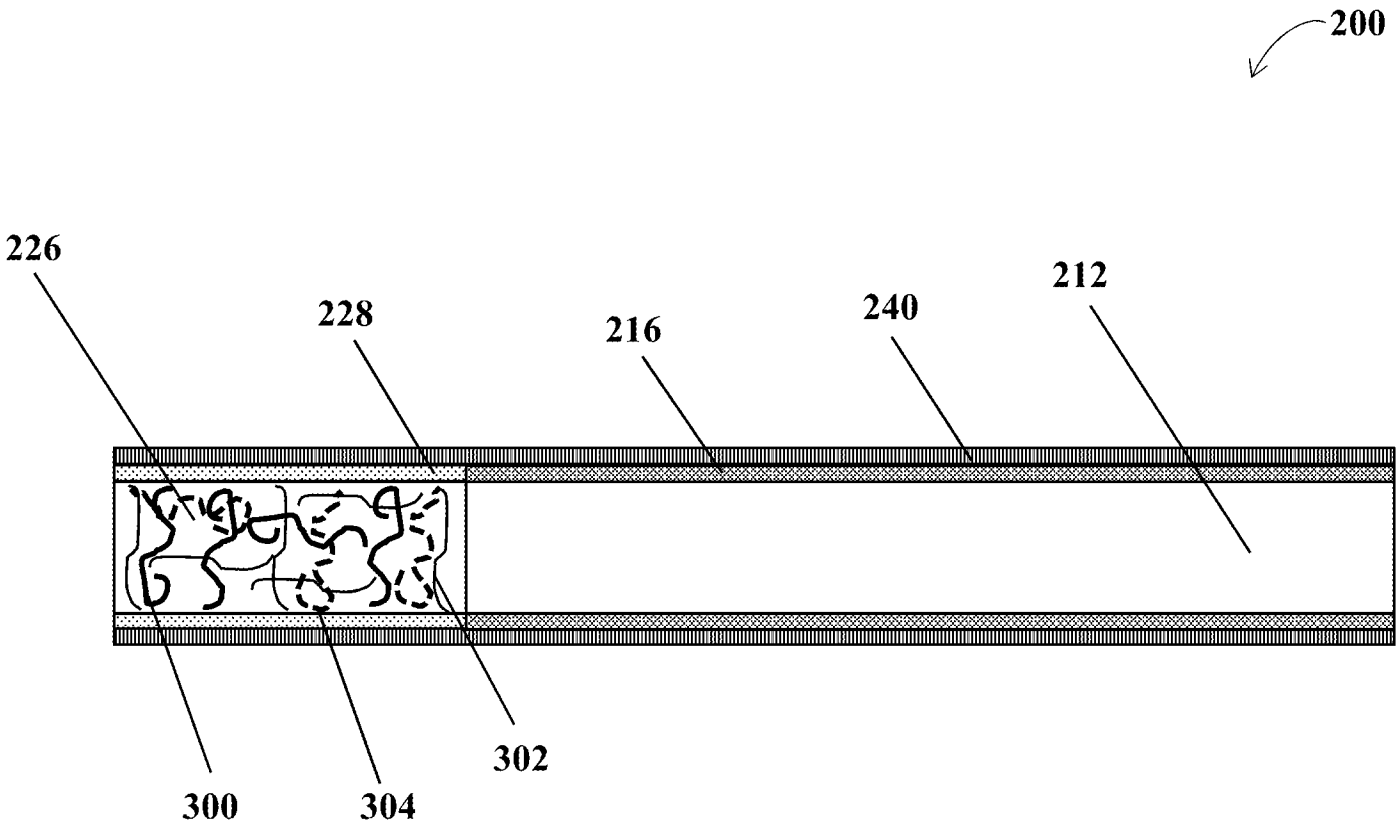
FIG. 3 is a cross-sectional view of a filter element in accordance with the methods disclosed herein.

FIG. 3 illustrates a cross sectional view of a cigarette 200 with a mixed fibrous bundle filter element 226 attached to a tobacco rod 212. The mixed fibrous bundle filter element 226 comprises a first plurality of staple fibers 300 and a second plurality of staple fibers 302. As shown in FIG. 3, the staple fibers are randomly oriented within the filter element. As described above, the fibrous bundle-based filter element 226 can further include a third plurality of staple fibers and/or cut tobacco 304.

EXPERIMENTAL

Example 1

Mixed staple fiber filters are created using a Randomly Oriented Acetate™ (ROA™) process. The ROA™ process takes a fibrous input material and chops it into smaller fibers. Steam is used to bond the finished filter.

Several different inputs are used to create mixed staple fiber filters: (1) 70/30 weight ratio cellulose acetate/cellulose blended tow input; and (2) 70/30 weight ratio cellulose acetate/cellulose blended tow input with an additional additive input in order to increase the nitrogen content of the filter and thereby target a C:N ratio of about 25:1.

The ROA™ machine is set up with a control 2.5 dpf cellulose acetate fiber tow having a total denier of 30,000 item and dispersible plug wrap. Once all parameters are achieved, 5 trays are manufactured at a machine speed of 120 m/min. The input is switched to the 70/30 weight ratio cellulose acetate/cellulose blended tow input. Two trays are manufactured at a machine speed of 120 m/min. Prior to the addition of any additive, a 10 rod sample is collected and the weight is recorded. Additives are fed to the machine by hand. The additives sampled include: (a) 5 weight percent cut tobacco; (b) 10 weight percent cut tobacco; (c) 5 weight percent green tea; (d) 10 weight percent green tea; (e) 5 weight percent coffee; (f) 10 weight percent coffee; (g) 5 weight percent soy lecithin. The tobacco has an estimated C:N ratio of about 13-21:1. The green tea has an estimated C:N ratio of about 9-11:1. The coarse ground coffee has an estimated C:N ratio of about 20:1. The soy granules have an estimated C:N ratio of about 4-6:1. Due to the fact that the soy granules are sticky and clump together, this additive is unable to be tested.

The selected additive is added to the tow band just before it enters the ROA™ unit. In order to maintain tow weights for additive calculations, pressure drop is allowed to float upon addition of the additive. Samples of rods with the additive are collected and the weight percent of additive is calculated using the dry weight recorded for the tow without the additive. Feed rate of the additive is adjusted as necessary to achieve the target loading percentages.

The ROA™ process returns an acceptable rod hardness of >90% on all trial samples. Pressure drop increases due to additive introduction are relatively proportional to the percent of additive added. There are no significant issues with utilizing dispersible plug wrap in combination with the steam required for ROA™ processing.

Example 2

The process described in Example 1 above is followed using soybean flour as another particulate additive in order to increase the nitrogen content of the filter to sufficiently high levels to increase the biodegradation rate. The nitrogen content of tobacco is low compared to soybean flour. A C/N ratio somewhere between 20-30:1 is targeted in this trial.

Example 3

Mixed staple fiber filters created using an ROA™ process as described in Example 1 are tested for biodegradability. The filters tested are: (1) Eastman® cellulose acetate control; (2) 70/30 weight ratio cellulose acetate/cellulose blended tow input without additives; and (3) filters formed from straw lorken input, which is a wheat straw used as a second control. Pure cellulose is also tested for comparison purposes. Anerobic landfill biodegradation, aerobic marine biodegradation, and soil biodegradation are each tested for each of the samples. The results are listed in Table 1 below. The results are normalized to 100% biodegradation of the cellulose.

TABLE 1

Relative Biodegradation Results Compared to Pure Cellulose for ROA Filters

| Test Item | % Anerobic Landfill Biodegradation in 22 days by ASTM D5511 | % Aerobic Marine Biodegradation in 28 days by ASTM D6691 | % Soil Degradation in 122 days by ASTM D5988 |
|---|---|---|---|
| Avicel Cellulose Powder (Merk 2331) | 100 | 100 | 100 |
| Wheat Straw (*Triticum* spp.) | 69 | 11 | 62 |
| Cellulose Acetate ROA filter with no additives; dispersible plug wrap; no tipping paper | 100 | 30 | 32 |
| 70/30 weight ratio cellulose acetate/cellulose blended ROA filter without additives; dispersible plug wrap; no tipping paper | 100 | 43 | 47 |

ROA filters formed from a 70/30 weight ratio cellulose acetate/cellulose blended tow input without additives are over 40% more biodegradable than ROA filters formed from only cellulose acetate.

Many modifications and other embodiments of the disclosure will come to mind to one skilled in the art to which this disclosure pertains having the benefit of the teachings presented in the foregoing description; and it will be apparent to those skilled in the art that variations and modifications of the present disclosure can be made without departing from the scope or spirit of the disclosure. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for forming a fibrous bundle suitable for use in a filter element for a smoking article, the method comprising:

blending a first plurality of cellulose acetate staple fibers with a second plurality of staple fibers to give a fiber mixture, wherein each of the staple fibers of the second plurality of staple fibers comprises a hydrophobic viscose fiber, and wherein the staple fibers of the fiber mixture are randomly oriented;

bonding the staple fibers of the fiber mixture to form a fibrous bundle; and incorporating the fibrous bundle into a filter element for a smoking article;

wherein the amount of cellulose acetate staple fibers in the fiber mixture is sufficient to give the filter element a rod hardness of at least about 90%;

wherein the weight ratio of the first plurality of cellulose acetate fibers to the second plurality of staple fibers is about 25:75 to about 75:25; and wherein the blending step further comprises blending cut tobacco with the fiber mixture in an amount of about 2% to about 10% by weight, based on the total weight of the fiber mixture.

2. The method of claim 1, wherein an additive to improve flavor is added to the cut tobacco.

3. The method of claim 1, wherein an additive to improve flavor is added to at least one of the first plurality of cellulose acetate staple fibers and the second plurality of staple fibers.

4. The method of claim 1, wherein the bonding step comprises treating the fiber mixture with a bonding agent comprising at least one of a plasticizer and steam.

5. The method of claim 1, wherein the first plurality of cellulose acetate staple fibers and the second plurality of staple fibers have lengths in the range of about ⅛ inch to about 2 inches.

6. The method of claim 1, wherein the first plurality of cellulose acetate staple fibers and the second plurality of staple fibers have lengths of about ⅜ inch or greater.

7. The method of claim 1, further comprising blending a third plurality of staple fibers with the first plurality of cellulose acetate staple fibers and the second plurality of staple fibers to form the fiber mixture.

8. The method of claim 7, wherein the third plurality of staple fibers comprises a degradable polymeric material selected from the group consisting of proteins, polysaccharides and combinations thereof.

9. The method of claim 1, wherein the filter element comprises rapidly disintegrating plug wrap for improved biodegradation.

10. A filter element comprising:

a first plurality of cellulose acetate staple fibers blended with a second plurality of staple fibers to give a fiber mixture; and wherein each of the staple fibers of the second plurality of staple fibers comprises a hydrophobic viscose fiber;

wherein the amount of cellulose acetate staple fibers in the fiber mixture is sufficient to give the filter element a rod hardness of at least about 90%;

wherein the staple fibers of the fiber mixture are randomly oriented;

wherein the weight ratio of the first plurality of cellulose acetate fibers to the second plurality of staple fibers is about 25:75 to about 75:25; and wherein the fiber mixture further comprises cut tobacco in an amount of about 2% to about 10% by weight, based on the total weight of the fiber mixture.

11. The filter element of claim 10, wherein the first plurality of cellulose acetate staple fibers and the second plurality of staple fibers have lengths of about ⅜ inch or greater.

12. The filter element of claim 10, further comprising a degradable plug wrap circumscribing the fiber mixture.

13. The filter element of claim 10, further comprising a third plurality of staple fibers blended with the first plurality of cellulose acetate staple fibers and the second plurality of staple fibers to form the fiber mixture.

14. The filter element of claim 13, wherein the third plurality of staple fibers comprises a degradable polymeric material selected from the group consisting of proteins, polysaccharides and combinations thereof.

15. The filter element of claim 10, wherein the filter element exhibits a degradation rate that is at least about 50% faster than that of a traditional cellulose acetate filter element.

16. A cigarette, comprising a rod of smokable material and a filter element according to claim 10 attached thereto.

17. The method of claim 1, wherein the hydrophobic viscous fiber comprises covalently bound water repellant hydrocarbon chains inside the fiber.

18. The method of claim 1, further comprising blending a nitrogen-containing additive selected from the group consisting of green tea, soybean flour, coffee beans, and combinations thereof into the fiber mixture.

19. The method of claim 4, wherein the bonding agent comprises triacetin.

20. The method of claim 1, wherein the shape of the individual filament cross-sections of at least one of the first plurality of cellulose acetate staple fibers and the second plurality of staple fibers is "Y" shaped.

21. The filter element of claim 10, wherein the hydrophobic viscous fiber comprises covalently bound water repellant hydrocarbon chains inside the fiber.

22. The filter element of claim 10, further comprising a nitrogen-containing additive selected from the group consisting of green tea, soybean flour, coffee beans, and combinations thereof blended with the fiber mixture.

23. The filter element of claim 10, wherein fiber mixture is bound with a bonding agent comprising triacetin.

24. The filter element of claim 10, wherein the shape of the individual filament cross-sections of at least one of the first plurality of cellulose acetate staple fibers and the second plurality of staple fibers is "Y" shaped.

* * * * *